US011163327B2

(12) United States Patent
Perez et al.

(10) Patent No.: US 11,163,327 B2
(45) Date of Patent: Nov. 2, 2021

(54) DIGITALLY ASSISTED LOW DROPOUT (LDO) VOLTAGE REGULATOR

(71) Applicant: International Business Machines Corporation, Armonk, NY (US)

(72) Inventors: Miguel E. Perez, Poughkeepsie, NY (US); Michael Sperling, Poughkeepsie, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 66 days.

(21) Appl. No.: 16/686,404

(22) Filed: Nov. 18, 2019

(65) Prior Publication Data

US 2021/0149422 A1 May 20, 2021

(51) Int. Cl.

| | |
|---|---|
| ***G05F 1/59*** | (2006.01) |
| ***G05F 1/575*** | (2006.01) |
| ***G05F 1/46*** | (2006.01) |
| ***G05F 1/563*** | (2006.01) |
| ***G05F 1/565*** | (2006.01) |

(52) U.S. Cl.

CPC ..... *G05F 1/59* (2013.01); *G05F 1/462* (2013.01); *G05F 1/563* (2013.01); *G05F 1/565* (2013.01); *G05F 1/575* (2013.01)

(58) Field of Classification Search

CPC . G05F 1/59; G05F 1/462; G05F 1/563; G05F 1/565; G05F 1/575

See application file for complete search history.

(56) References Cited

U.S. PATENT DOCUMENTS

| | | | | |
|---|---|---|---|---|
| 7,199,565 | B1 | 4/2007 | Demolli | |
| 10,216,209 | B1 * | 2/2019 | Ham | G05F 1/59 |
| 10,488,876 | B1 * | 11/2019 | Jackum | G05F 1/59 |
| 2007/0210770 | A1 * | 9/2007 | Dean | G05F 1/46 323/273 |
| 2009/0033298 | A1 * | 2/2009 | Kleveland | G05F 1/575 323/271 |
| 2014/0223205 | A1 | 8/2014 | Muthukaruppan et al. | |
| 2014/0277812 | A1 | 9/2014 | Shih et al. | |
| 2017/0003699 | A1 * | 1/2017 | Lin | G05F 1/575 |
| 2018/0329440 | A1 * | 11/2018 | Jefremow | G05F 1/59 |
| 2020/0293076 | A1 * | 9/2020 | Hsieh | G05F 1/575 |

OTHER PUBLICATIONS

Patra, P. et al., "A reliable Digitally Synthesizable Linear Drop-out regulator design for 14nm SOC," 2015, IEEE International Symposium on Nanoelectronic and Information Systems, IEEE Computer Society, pp. 73-76.

* cited by examiner

*Primary Examiner* — Jue Zhang
(74) *Attorney, Agent, or Firm* — Cantor Colburn LLP; Margaret McNamara

(57) ABSTRACT

Aspects of the invention include a circuit having a two-stage amplifier coupled to a transistor array and to a comparator, the transistor array being configured to provide an output to a load, the transistor array including transistors. The circuit includes a controller coupled to the comparator and to the transistor array, the two-stage amplifier being configured to modulate a current density in the transistor array via gate terminals of the transistors, wherein, by using the comparator and the controller, the two-stage amplifier is configured to modulate a number of the transistors that are to couple to the load.

19 Claims, 5 Drawing Sheets

100
N BIT SHIFT REGISTER
108
N
104
PFET ARRAY
VIN
112
$I_{OUT}$
226
VOUT
110
$C_L$
$R_L$
114
118
LOOP #2: SLOW DIGITAL LOOP
LOOP #1: FAST ANALOG LOOP
CMP
106
$V_{EA-}$
$V_{EA+}$
$V_G$
220
202
VIN
$P_G$
222
$P_X$
206
204
$N_C$
210
224
$I_{REF}$
HIGH-SPEED TWO-STAGE AMPLIFIER
102
LOOP #3: SLOW ANALOG LOOP
VREP
VREF
EA
208
VOUT
VREF 100
108
N BIT SHIFT REGISTER
N
504
NFET ARRAY
VIN
512
$V_G$
VOUT
$I_{OUT}$
226
110
$C_L$
$R_L$
114
118
LOOP #2: SLOW DIGITAL LOOP
LOOP #1: FAST ANALOG LOOP
106
CMP
$V_{EA-}$
$V_{EA+}$
$I_{REF}$
102
HIGH-SPEED TWO-STAGE AMPLIFIER
VIN
$N_G$
502
520
522
2xVIN
204
VREF
VREP
$N_C$
210
224
$V_{EA-}$
$V_{EA+}$
EA
208
VOUT
VREF
LOOP #3: FAST ANALOG LOOP

DIGITALLY ASSISTED LOW DROPOUT (LDO) VOLTAGE REGULATOR

BACKGROUND

The present invention generally relates to integrated circuits, and more specifically, to a digitally assisted low dropout (LDO) voltage regulator.

In an electronic device, power is needed to run the device. Semiconductor devices, such as microprocessors, standalone and embedded memory devices, etc., receive power from a power supply or supply voltage. A low-dropout, low dropout, or LDO regulator is a linear voltage regulator that can regulate the output voltage even when the supply voltage is very close to the output voltage. In electronics, a linear regulator is a system used to maintain a steady voltage. The resistance of the regulator varies in accordance with the load resulting in a constant voltage output. The regulating device is made to act like a variable resistor, continuously adjusting a voltage divider network to maintain a constant output voltage and continually dissipating the difference between the input and regulated voltages as waste heat. The usefulness of a low dropout voltage regulator over other DC to DC regulators includes the absence of switching noise (as no switching takes place), smaller device size (as neither large inductors nor transformers are needed), and greater design simplicity. However, unlike switching regulators, linear voltage regulators have to dissipate power, and thus heat, across the regulation device in order to regulate the output voltage.

SUMMARY

Embodiments of the present invention are directed to a digitally assisted low dropout (LDO) voltage regulator. A non-limiting example circuit includes a two-stage amplifier coupled to a transistor array and to a comparator, the transistor array being configured to provide an output to a load, the transistor array including transistors. Also, the circuit includes a controller coupled to the comparator and to the transistor array, the two-stage amplifier being configured to modulate a current density in the transistor array via gate terminals of the transistors, wherein, by using the comparator and the controller, the two-stage amplifier is configured to modulate a number of the transistors that are to couple to the load.

A non-limiting example method of forming a circuit includes providing a two-stage amplifier coupled to a transistor array and to a comparator, the transistor array being configured to provide an output to a load, the transistor array including transistors. Also, the method includes coupling a controller to the comparator and the transistor array, the two-stage amplifier being configured to modulate a current density in the transistor array via gate terminals of the transistors, where, by using the comparator and the controller, the two-stage amplifier is configured to modulate a number of the transistors that are to couple to the load.

A non-limiting example circuit includes a two-stage amplifier comprising an error amplifier, a replica amplifier, a replica transistor, a first transistor, and a second transistor, the two-stage amplifier being coupled to a transistor array and to a comparator, the transistor array being configured to provide an output to a load, the transistor array including transistors. Also, the circuit includes a controller coupled to the comparator and to the transistor array, the two-stage amplifier being configured to modulate a current density in the transistor array via gate terminals of the transistors, where, by using the comparator and the controller, the two-stage amplifier is configured to modulate a number of the transistors that are to couple to the load.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

Figure 1:
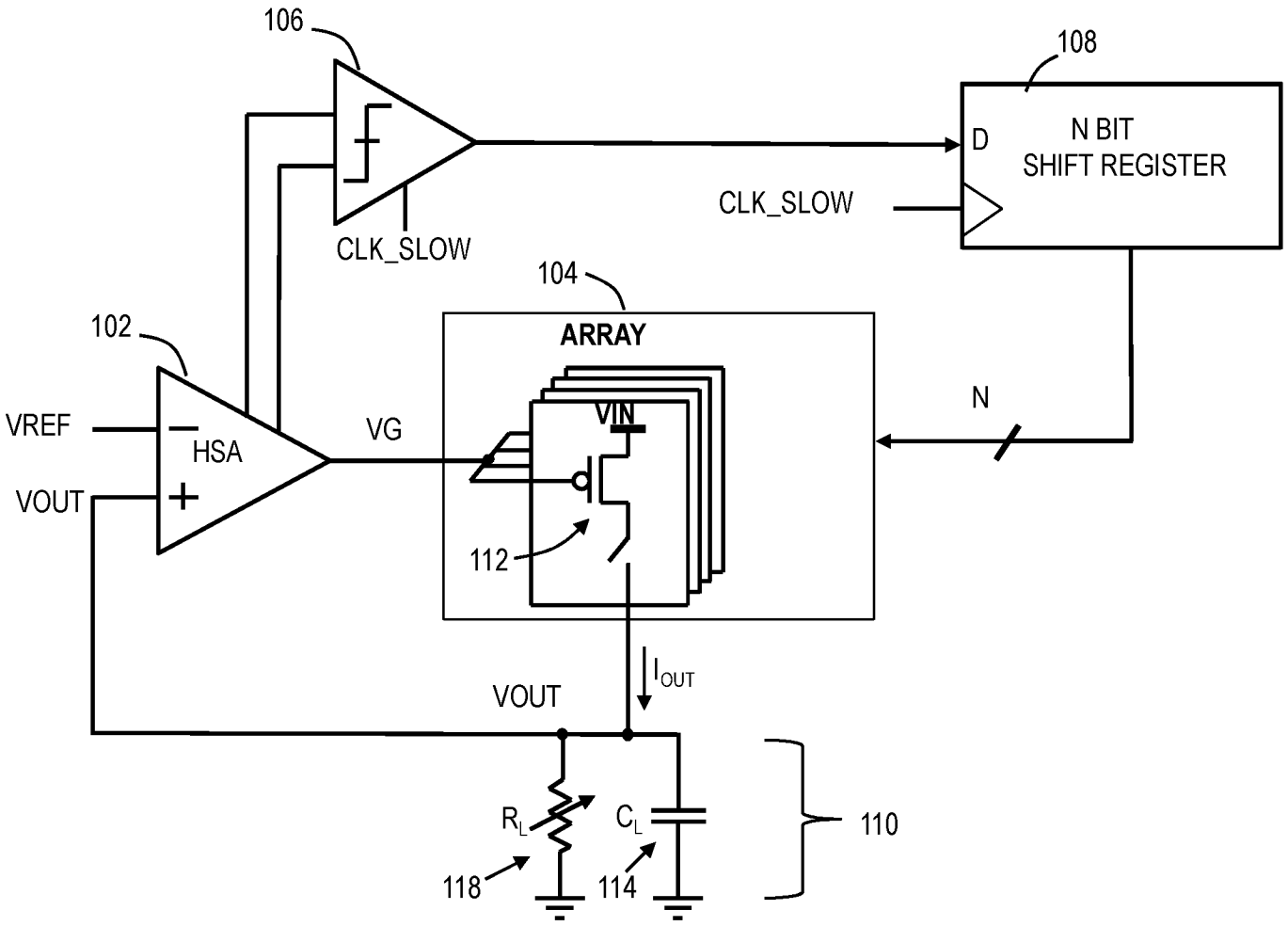
FIG. 1 illustrates a block diagram of an example circuit in accordance with one or more embodiments of the present invention.

The diagrams depicted herein are illustrative. There can be many variations to the diagrams or the operations described therein without departing from the spirit of the invention. For instance, the actions can be performed in a differing order or actions can be added, deleted or modified. Also, the term "coupled" and variations thereof describes having a communications path between two elements and does not imply a direct connection between the elements with no intervening elements/connections between them. All of these variations are considered a part of the specification.

DETAILED DESCRIPTION

One or more embodiments of the present invention provide a digitally assisted low dropout (LDO) voltage regulator with a first feedback loop and a second feedback loop forming a dual loop, along with a third feedback loop. One or more embodiments mitigate electromigration (EMIR) concerns by providing the third feedback loop which maintains a constant current density (e.g., microamps (μA)/fin) in a passgate device in view of voltage and output current variation. The fin has a length dimension, a width dimension, and height dimension. The third feedback loop is used in conjunction with the dual loop architecture which has a slow but high-gain digital loop that ensures high regulation precision and a fast analog loop that provides immediate response to sudden load steps (load current).

As complementary metal-oxide-semiconductor (CMOS) technologies continue to scale and power density increases, electromigration (EMIR) can become a limiting factor in a system's long-term reliability and performance. EMIR's exponential dependence on temperature can make matters worse due to excessive self-heating in electronic devices.

This condition is exacerbated in systems implemented in substrate on insulator (SOI) technologies, where the substrate's thermal resistance is large, or microprocessors, where device density (and therefore power density) is extremely high. It is thus desirable to have circuits where the current density in certain devices is precisely controlled. On-chip voltage regulators can reach especially high-power density levels due to their large output power, and as such, the ability to precisely control the current density of certain devices is central to ensuring high performance in a system that employs such regulators. In addition, in the presence of highly dynamic loads, such as high-performance microprocessors, it becomes imperative to be able to respond rapidly to sudden changes in load current demand to avoid damaging voltage droops.

One or more embodiments of the present invention address one or more of the above-described shortcomings of the prior art by providing the digitally assisted low dropout (LDO) voltage regulator. The LDO voltage regulator has a hybrid (analog and digital) architecture capable of maintaining a constant current per transistor in a passgate p-type metal-oxide-semiconductor (PMOS) array in the face of voltage (VIN/VOUT) and output current (TOUT) variation to mitigate EMIR concerns in deeply scaled CMOS technologies, which can be exacerbated by self-heating if devices are allowed to output high currents.

Referring to FIG. 1, a circuit 100 is illustrated for a digitally assisted low dropout (LDO) voltage regulator in accordance with one or more embodiments of the present invention. The circuit 100 is an integrated circuit that provides a hybrid architecture which includes an analog and digital structure capable of maintaining a constant current per transistor 112 in a passgate p-type field effect transistor (PFET) array 104 in the view of the voltage (VIN/VOUT) and output current ($I_{OUT}$) variation to mitigate EMIR (electromigration) in deeply scaled CMOS technologies. Although a PFET array is illustrated, it should be appreciated that embodiments of the invention are not meant to be limited to a PFET array and an n-type field effect transistor (NFET) array can be utilized as discussed in FIG. 5.

Figure 2:
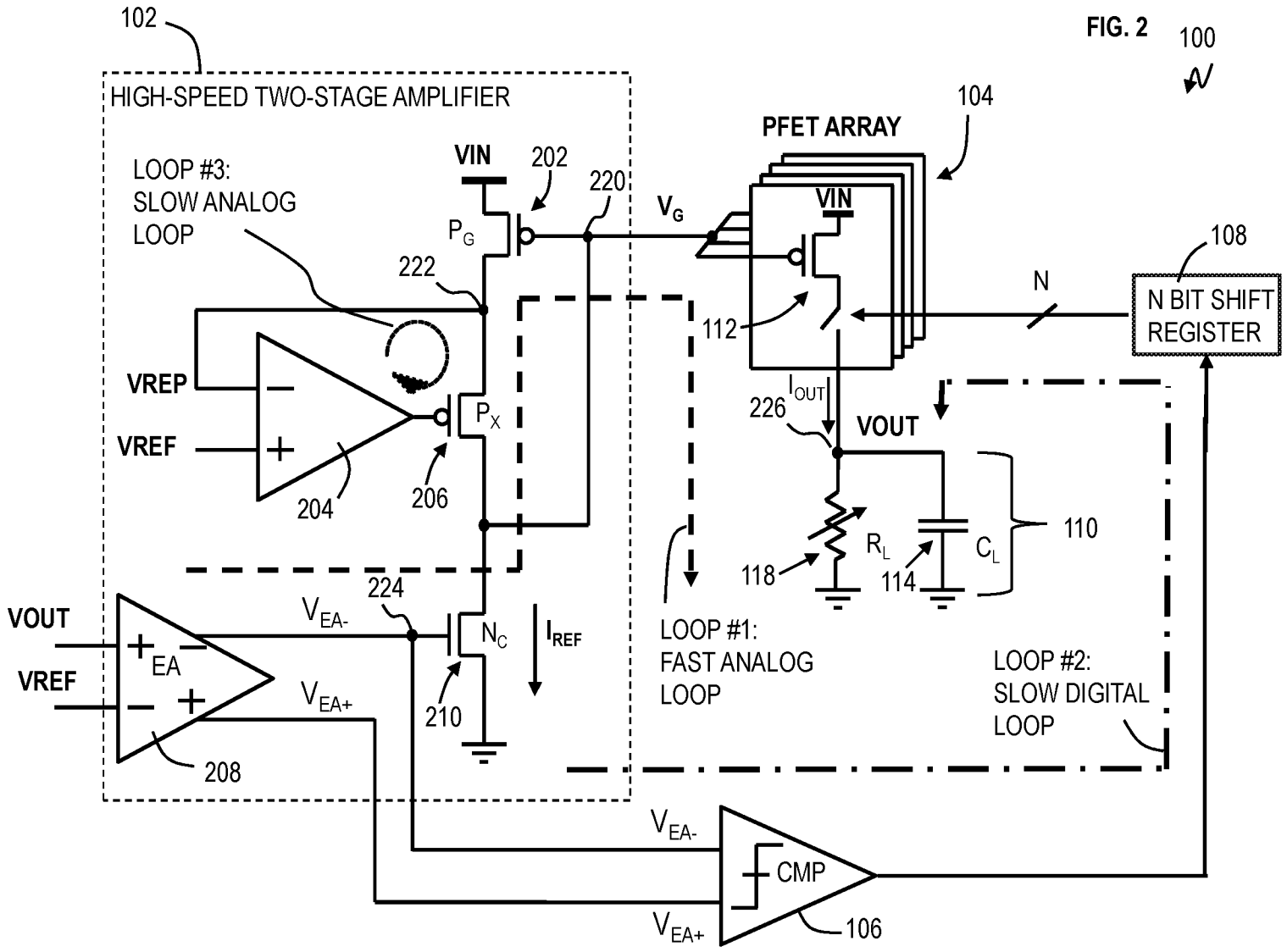
FIG. 2 illustrates a block diagram with further details of the circuit in accordance with one or more embodiments of the present invention.

FIG. 1 depicts a high-level diagram of the circuit 100 which includes an amplifier 102 coupled to the PFET array 104. The amplifier 102 is a high-speed two-stage amplifier and further details of an example amplifier are depicted in FIG. 2. Referring back to FIG. 1, the amplifier 102 provides an output which is the gate voltage (VG) to the transistors 112 in the PFET array 104. The amplifier 102 is coupled to a comparator 106 in order to provide outputs for comparison by the comparator 106. The PFET array 104 provides output voltage (VOUT) to a load 110 along with output current ($I_{OUT}$). The load 110 includes a variable resistance 118 designated as variable resistor $R_L$ and may include capacitance 114 designated as $C_L$. An input terminal of the amplifier 102 is coupled to the output of the PFET array 104 to receive the output voltage VOUT. The other input terminal of amplifier 102 receives a programmable reference voltage (VREF).

The output of the comparator 106 is provided to a controller 108. In one or more embodiments, the controller 108 can be an N bit shift register. The controller 108 outputs an N bit digital code that controls the number of active transistors inside the PFET array that are able to source current to the load 110. The controller 108 is configured to receive a signal output from the comparator 106 and either add or subtract transistors 112 in the PFET array 104 by, for example, closing or opening switches respectively connecting individual transistors 112 to the output voltage VOUT. If the signal output from the comparator 106 is high, the controller 108 increases the value of its output digital code to activate more transistors. If the signal output from the comparator 106 is low, the controller 108 decreases the value of its output digital code to deactivate more transistors. The comparator 106 and controller 108 can receive a clock signal for operation according to clock cycles on the integrated circuit.

FIG. 2 is a block diagram illustrating a more detailed view of the circuit 100 according to one or more embodiments of the invention. In particular, FIG. 2 illustrates internal details of the amplifier 102. The amplifier 102, which is the high-speed two-stage amplifier, includes a replica transistor 202 (e.g., PFET) which is a replica to or approximately identical to the transistors 112 in PFET array 104 and is designated as $P_G$ transistor. The transistors 112 are identical and/or approximately identical.

The replica transistor 202 has its gate at a node 220 coupled to the gates of the transistors 112 in the PFET array 104. The sources of the transistors 112 and replica transistor 202 are coupled to a power supply (VIN). The drain of replica transistor 202 is coupled to a node 222 where representative voltage VREP is measured. An amplifier 204 has its negative (inverting) input terminal coupled to the node 222, its positive input terminal coupled to the reference voltage (VREF), and its output terminal coupled to the gate of a transistor 206. The source of the transistor 206 is coupled to node 222 while its drain is coupled to node 220. The amplifier 204 can be a DC amplifier, an operational amplifier, etc. The transistor 206 can be a PFET and is designated as $P_X$ transistor.

A transistor 210, designated as $N_C$ transistor, has its source coupled to ground and its drain coupled to node 220. The gate of transistor 210 is coupled to a node 224, and the transistor 210 can be an n-type FET (NFET). An error amplifier (EA) 208 has its positive (non-inverting) input terminal coupled to receive $V_{OUT}$ and its negative (inverting) input terminal coupled to receive VREF. The negative differential output of the error amplifier 208 is coupled to node 224, and node 224 is coupled to the first input terminal of the comparator 106. The positive differential output of the error amplifier 208 is coupled to the second input terminal of the comparator 106. The error amplifier 208 is configured to provide a differential output voltage that is a differential of input voltages (e.g., differential of voltage VOUT and VREF) on the input terminals, and the differential output voltage (e.g., designated as $V_{EA}$) on the negative differential output terminal is greater than the differential output voltage (e.g., designated as $V_{EA+}$) on the positive differential output terminal of the error amplifier 208. That is, node 224 is a high impedance node, and thus the voltage on the negative differential output terminal has a greater magnitude than the voltage on the positive differential output terminal of the error amplifier 208 given a small change in VOUT.

By coupling the output of the comparator 106 to the controller 108 (e.g., a shift register), the output of the comparator 106 signals the controller 108 to add or subtract transistors 112 in PFET array 104. The controller 108 then outputs a digital code that controls the number of the transistors 112 in PFET array 104 that are to be connected to the load 110 via node 226 at which VOUT is measured.

When the current density of the transistors 112 of PFET array 104 is at the desired level, the following relationship applies voltage VREP=VOUT=VREF. If voltage VOUT is less than voltage VREF, the controller 108 (e.g., shift register) increases the value of its output digital code, which in turn switches on more transistors 112 (PFETs) in the PFET array 104. If voltage VOUT is greater than VREF, the controller 108 (e.g., shift register) decreases the value of its output digital code which in turn switches off transistors 112 in the PFET array 104. Controller 108 can change its output digital code in response to the output signal of the comparator 106 in a linear, and/or non-linear fashion (e.g., exponentially, quadratically, etc.). Loop 1 and loop 2 maintain VOUT=VREF while input voltage VIN is changing and while load resistance 118 ($R_L$) is changing. Loop 3 is a feedback loop that maintains voltage VREP=VREF and includes the amplifier 204 and transistor 206. Feedback loop 3 with assistance from the digital loop 2 keeps current $I_{REF}$ constant even in the face of changing VREF, $R_L$, and VIN. The current $I_{OUT}$ is the total current combined for each of the transistors 112. The PFET array 104 consists of $2^N$ individual PFETs whose width (or number of fins) can be defined as $W_{LSB}$ (or $K_{LSB}$), where $W_{LSB}$ is for planar devices and $K_{LSB}$ is for finFETs. The replica PFET $P_G$ has a width (or number of fins) defined as $W_G$ (or $K_G$). The current per transistor 112 can be defined as Us and its relation to $I_{REF}$ can be represented as $I_{LSB}=(W_{LSB}/W_G)*I_{REF}$ or $I_{LSB}=(K_{LSB}/K_G)*I_{REF}$ in the steady-state (once loop 3 has settled and loop 2 has reached its limit cycle oscillation). The steady state of the circuit 100 stabilizes to $I_{REF}$ (where $I_{REF}$ is controlled) in the long term, which allows for the precise control of the power density per transistor 112 in PFET array 104. This capability helps to reduce the risk of electromigration-induced system failure by maintaining device self-heating below a desired threshold.

One or more example scenarios are provided below for explanation purposes and not limitation. One or more embodiments implement a hybrid dual loop LDO voltage regulator in conjunction with a third feedback loop to maintain a constant power density across each transistor 112 in PFET array 104 while also being capable of responding rapidly to sudden changes on load current demand. Loop 1 is designed to react rapidly to any sudden load steps so as to avoid damaging voltage droops on VOUT. To this end, it couples the output of a high-speed two stage amplifier 102 to the gate terminal of PFET array 104 such that the $I_{LSB}$ of each active transistor 112 (and thus $I_{OUT}$) can be modulated swiftly in response to fast changes in $R_L$. Loop 2 is a low speed high gain digital loop that ensures a high precision of regulation in the LDO voltage regulator. Loop 2 couples a comparator 106 to the differential outputs ($V_{EA-}$, $V_{EA+}$) of error amplifier 208. Loop 2 also couples the output of comparator 106 to controller 108 such that controller 108 outputs a code to either add or subtract transistors 112 in PFET array 104 so as to force $V_{EA-}=V_{EA+}$. Given that $V_{EA-}-V_{EA+}=A_0*(VOUT-VREF)$, where $A_0$ is the DC gain of error amplifier 208, if $V_{EA-}=V_{EA+}$, then VOUT=VREF. Loop 3 is a low-speed high-gain analog feedback loop, whose main objective is to ensure that VREP=VREF. Given that the source and gate terminals of replica device $P_G$ and active transistors 112 in PFET array 104 share the same connections, once loop 3 settles and VREP=VREF, $I_{LSB}=(W_{LSB}/W_G)*I_{REF}$ must be true. At this point, $I_{REF}$ equals its originally biased value and circuit 100 has reached equilibrium. Due to the discrete nature and finite resolution of the PFET array 104, the digital loop reaches what is known as limit cycle oscillation (LCO) in the steady state. Here, one or several transistors 112 (depending on the LCO degree) are added and subtracted in a cyclical manner. This state, however, results in an undesirable ripple at the VOUT node. This unwanted effect is greatly mitigated in one or more embodiments of the present invention due to the action of the fast analog loop 1. Loop 1 greatly diminishes any unwanted ripple at node VOUT by modulating the gate terminal of PFET array 104 (and thus $I_{OUT}$) so as to counter the effect of the LCO generated by digital loop 2.

Figure 5:
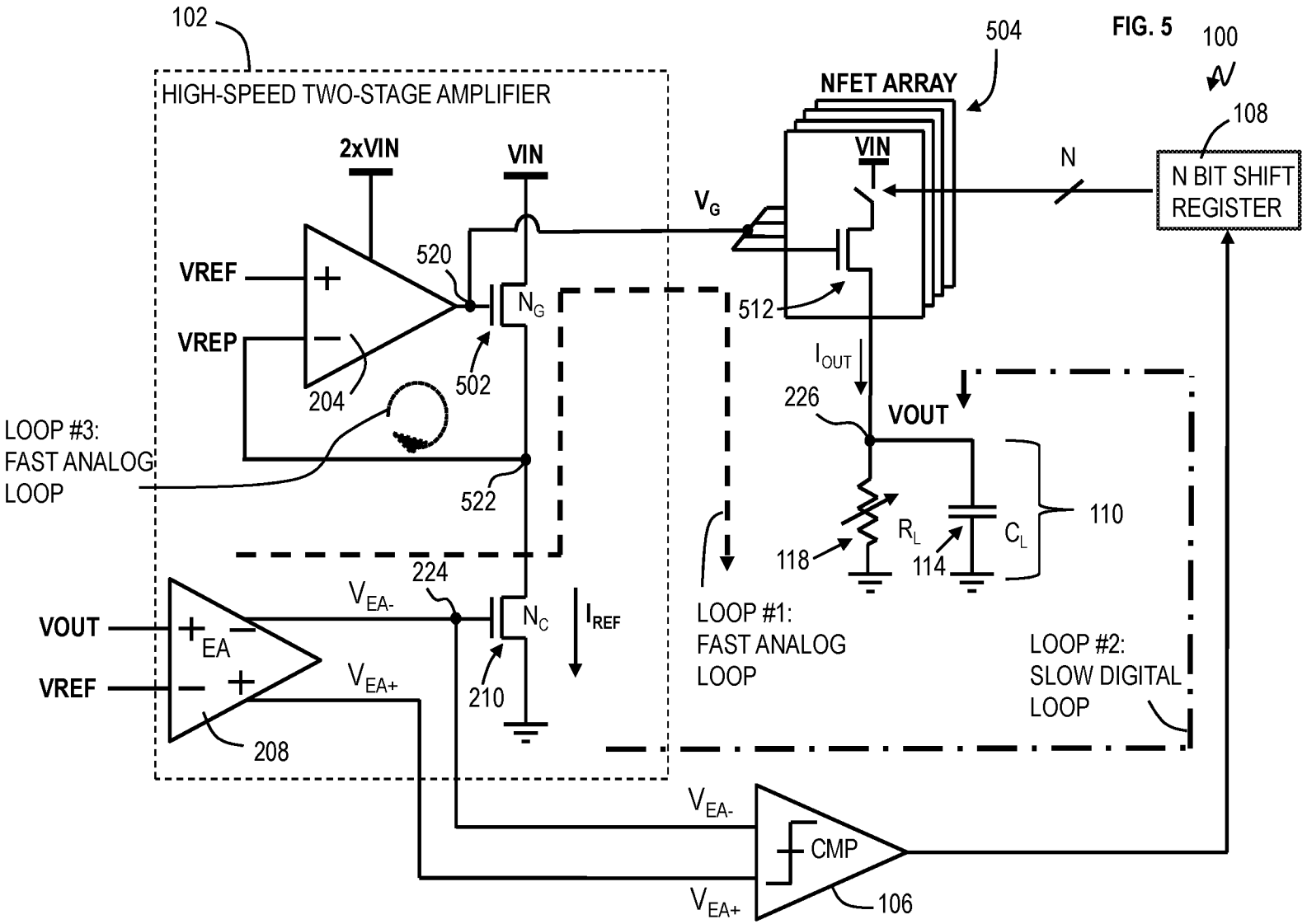
FIG. 5 illustrates a block diagram of an example circuit in accordance with one or more embodiments of the present invention.

It should be appreciated that although some examples depict the circuit 100 using the PFET array 104, the circuit 100 is not limited to a PFET array. The circuit 100 may include an NFET array 504 as depicted in FIG. 5. FIG. 5 is a block diagram of the circuit 100 for a digitally assisted low dropout (LDO) voltage regulator in accordance with one or more embodiments of the present invention. The circuit 100 in FIG. 5 provides an analogous LDO voltage regulator as discussed above in FIGS. 1 and 2. According to one or more embodiments of the present invention, FIG. 5 depicts a modification where the passgate transistor array 504 is made up of NMOS transistors, for example, NFET transistors 512. Also, the amplifier 102 includes NFET replica transistor 502 ($N_G$ transistor) having its gate connected at node 520 to the output of amplifier 204 and the gates of NFET transistors 512. Additionally, the negative terminal of amplifier 204 is coupled at node 522 to the source of replica transistor 502 and drain of transistor 210. The source of transistor 210 is coupled to ground. The power supply terminal of amplifier 204 is coupled to a voltage source that provides twice the value of the input voltage VIN (i.e., 2 times VIN). This higher voltage level (2×VIN) can be generated by a charge pump circuit.

In this case, there are 3 loops working in conjunction to maintain a desired power density per transistor 512 in the NFET array 504. Loop 1 is a high-speed analog loop that can detect and respond to sudden changes in VOUT. Loop 2 is a slow but high gain digital loop that ensures high precision of regulation in the NFET LDO regulator. Loop 2 consists of a comparator 106 coupled to the outputs of error amplifier 208 and whose output signals a controller 108 to add or subtract individual transistors 512 in NFET array 504 to force $V_{EA-}-V_{EA+}=0$. Loop 3 is a high-speed analog loop consisting of a replica amplifier 204 whose inputs are connected to VREP and VREF, and whose output is coupled to the gate terminals of replica transistor $N_G$ and of transistors 512 in the NFET array 504. Loop 3 is inside loop 2 and can react rapidly to sudden changes in VOUT. To illustrate this concept, it is assumed that VOUT drops suddenly, error amplifier 208 will amplify this negative change in VOUT by raising $V_{EA-}$, which will in turn lower VREP relative to its steady-state value. Loop 3 will react to bring VREP back to its original level and will thus raise the value of $V_G$ in order to achieve this. Raising $V_G$ will increase the current flowing through each active transistor 512 in the NFET array 504, thus helping bring VOUT back to the desired level where VOUT=VREF. At this point, $I_{REF}$ will be higher than its equilibrium level because $V_{EA-}>V_{EA+}$, which will cause comparator 106 to signal controller 108 to activate more transistors 512 in NFET array 504 until $V_{EA-}\sim V_{EA+}$ where the circuit 100 will settle into its steady state limit cycle oscillatory behavior. At this point, $V_{EA-}\sim V_{EA+}$, VOUT=VREF, VREP=VREF, and the current through each transistor 512 in NFET array 504 will be defined as $I_{LSB}=(W_{LSB}/W_G)*I_{REF}$ or $I_{LSB}=(K_{LSB}/K_G)*I_{REF}$, where $W_{LSB}$ is the width of and $K_{LSB}$ represents the number of fins in a single transistor 512 in the NFET array 504, depending on whether the semiconductor technology used to implement the circuit 100 employs planar devices ($W_{LSB}$) or finFETs ($K_{LSB}$).

Figure 3:
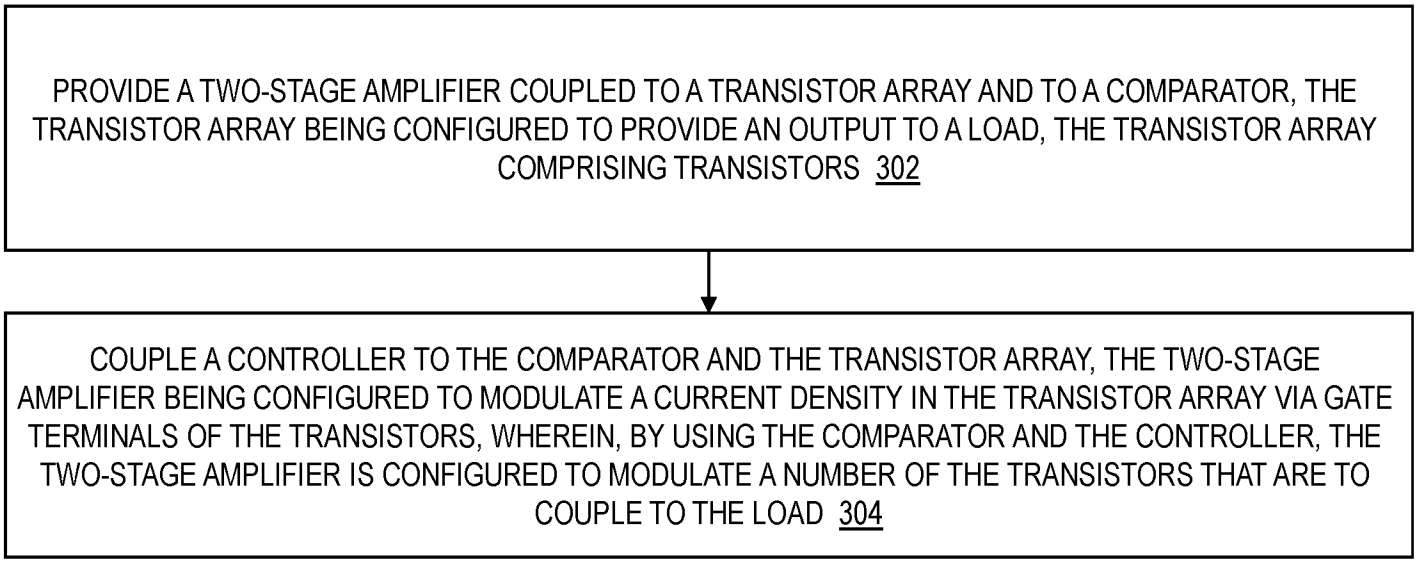
FIG. 3 illustrates a flow diagram of a method for configuring a circuit in accordance with one or more embodiments of the present invention.

FIG. 3 illustrates a flow diagram of a method 300 for configuring the circuit 100 in accordance with one or more embodiments of the present invention. At block 302, a two-stage amplifier (e.g., amplifier 102) is coupled to a transistor array (e.g., PFET array 104) and to a comparator 106, the transistor array being configured to provide an output (e.g., voltage VOUT) to a load 110, the transistor array comprising transistors (e.g., transistor 112). At block 304, a controller 108 is coupled to the comparator 106 and the transistor array (e.g., PFET array 104), the two-stage amplifier being configured to modulate a current density in the transistor array via gate terminals of the transistors, wherein, by using the comparator and the controller, the two-stage amplifier is configured to modulate a number of the transistors that are to couple to the load.

According to one or more embodiments, the two-stage amplifier (e.g., amplifier 102) is configured to modulate the current density in the transistor array via the gate terminals of the transistors 112 based on receiving the output (e.g., voltage VOUT) from the transistor array and a reference voltage (e.g., voltage VREF). The two-stage amplifier (e.g., amplifier 102) is configured to modulate the current density in the transistor array via the gate terminals (e.g., at node 220) of the transistors 112 by modulating a gate voltage (e.g., voltage $V_G$) provided to their gate terminals. By using the comparator 106 and the controller 108, the two-stage amplifier is configured to modulate the number of the transistors 112 that are to couple to the load 110 by causing the controller 108 to connect one or more of the transistors 112 to and disconnect one or more of the transistors 112 from the load 110. The two-stage amplifier (e.g., amplifier 102) is configured to provide a differential output (e.g., voltage $V_{EA-}$ and voltage $V_{EA+}$) to the comparator 106. Based on the differential output (e.g., voltage $V_{EA-}$ and voltage $V_{EA+}$), the comparator 106 is configured to output a positive difference or a negative difference to the controller 108. Based on receiving the positive difference, the controller 108 is configured to connect (e.g., add) one or more of the transistors 112 to the load, and based on receiving the negative difference, the controller 108 is configured to disconnect (e.g., subtract) one or more of the transistors 112 from the load 110. The current density comprises an amount of current through each of the transistors 112 coupled to the load 110. The two-stage amplifier (e.g., amplifier 102) is configured to increase or decrease the amount of current through each of the transistors 112 coupled to the load 110.

Figure 4:
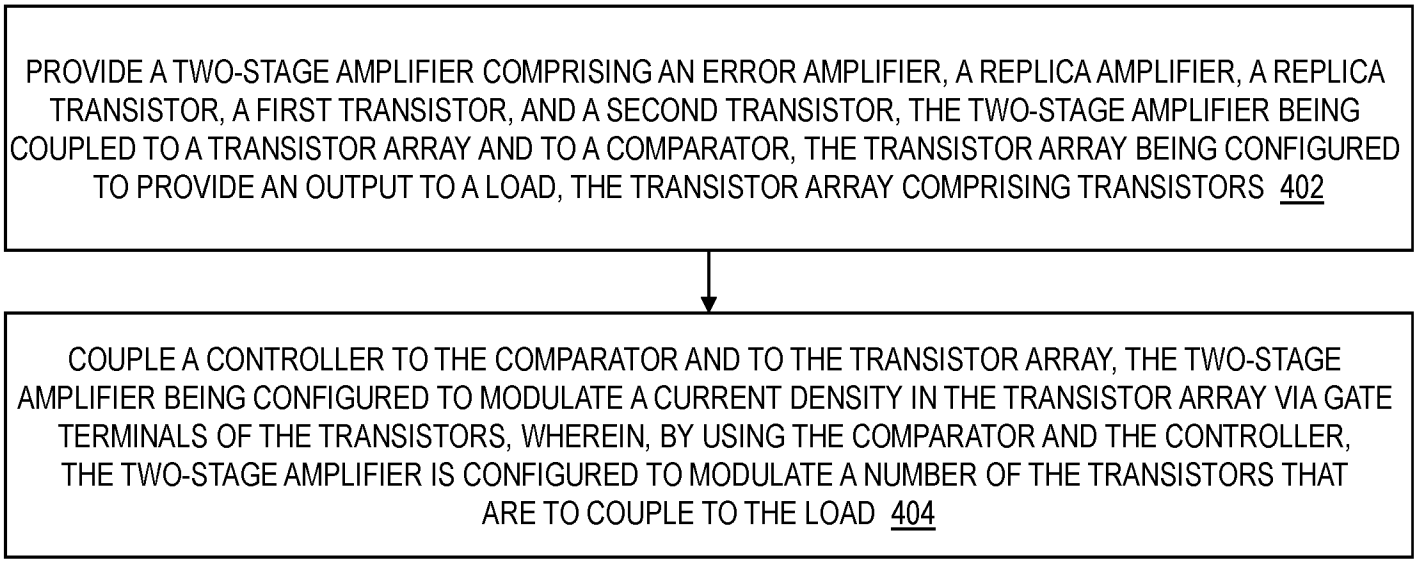
FIG. 4 illustrates a flow diagram of a method for configuring a circuit in accordance with one or more embodiments of the present invention.

FIG. 4 illustrates a flow diagram of a method 400 for configuring the circuit 100 in accordance with one or more embodiments of the present invention. At block 402, a two-stage amplifier (e.g., amplifier 102) comprises an error amplifier 208, a replica amplifier (e.g., amplifier 204), a replica transistor (e.g., $P_G$ transistor 202), a first transistor (e.g., $P_X$ transistor 206), and a second transistor (e.g., $N_C$ transistor 210), the two-stage amplifier being coupled to a transistor array (e.g., PFET array 104) and to a comparator 106, the transistor array being configured to provide an output (e.g., output voltage VOUT and output current $I_{OUT}$) to a load 110, the transistor array comprising transistors 112. At block 404, a controller 108 is coupled to the comparator 106 and to the transistor array (e.g., PFET array 104), the two-stage amplifier being configured to modulate a current density in the transistor array via gate terminals of the transistors 112, where, by using the comparator 106 and the controller 108, the two-stage amplifier is configured to modulate a number of the transistors 112 (e.g., $1\text{-}2^N$ transistors) that are to couple to the load 110.

The error amplifier 208 is coupled to the second transistor (e.g., $N_C$ transistor 210) and the comparator 106, the error amplifier being configured to provide a differential output (e.g., voltage $V_{EA-}$ and voltage $V_{EA+}$) to the comparator 106. An input terminal of the replica amplifier (e.g., amplifier 204) is coupled to the drain terminal of the replica transistor (e.g., $P_G$ transistor 202) and the source terminal of the first transistor (e.g., $P_X$ transistor 206), an output terminal of the replica amplifier (e.g., amplifier 204) being coupled to a gate of the first transistor (e.g., $P_X$ transistor 206).

Various embodiments of the invention are described herein with reference to the related drawings. Alternative embodiments of the invention can be devised without departing from the scope of this invention. Various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. Moreover, the various tasks and process steps described herein can be incorporated into a more comprehensive procedure or process having additional steps or functionality not described in detail herein.

One or more of the methods described herein can be implemented with any or a combination of the following technologies, which are each well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), etc.

For the sake of brevity, conventional techniques related to making and using aspects of the invention may or may not be described in detail herein. In particular, various aspects of computing systems and specific computer programs to implement the various technical features described herein are well known. Accordingly, in the interest of brevity, many conventional implementation details are only mentioned briefly herein or are omitted entirely without providing the well-known system and/or process details.

In some embodiments, various functions or acts can take place at a given location and/or in connection with the operation of one or more apparatuses or systems. In some embodiments, a portion of a given function or act can be performed at a first device or location, and the remainder of the function or act can be performed at one or more additional devices or locations.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The present disclosure has been presented for purposes of illustration and description, but is not intended to be exhaustive or limited to the form disclosed. Many modifications and variations will be apparent to those of ordinary skill in the art without departing from the scope and spirit of the disclosure. The embodiments were chosen and described in order to best explain the principles of the disclosure and the practical application, and to enable others of ordinary skill in the art to understand the disclosure for various embodiments with various modifications as are suited to the particular use contemplated.

The diagrams depicted herein are illustrative. There can be many variations to the diagram or the steps (or operations) described therein without departing from the spirit of the disclosure. For instance, the actions can be performed in a differing order or actions can be added, deleted or modified. Also, the term "coupled" describes having a signal path between two elements and does not imply a direct connection between the elements with no intervening elements/connections therebetween. All of these variations are considered a part of the present disclosure.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include both an indirect "connection" and a direct "connection."

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instruction by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A circuit comprising:

a two-stage amplifier coupled to a transistor array and to a comparator, differential output terminals of the two-stage amplifier are coupled to input terminals of the comparator, the transistor array being configured to provide an output to a load, the transistor array comprising transistors; and a controller coupled to the comparator and to the transistor array, the two-stage amplifier being configured to modulate a current density in the transistor array via gate terminals of the transistors, wherein, by using the comparator and the controller, the two-stage amplifier is configured to modulate a number of the transistors that are to couple to the load.

2. The circuit of claim 1, wherein the two-stage amplifier is configured to modulate the current density in the transistor array via the gate terminals of the transistors based on receiving the output from the transistor array and a reference voltage.

3. The circuit of claim 1, wherein the two-stage amplifier is configured to modulate the current density in the transistor array via the gate terminals of the transistors by modulating a gate voltage provided to the gate terminals.

4. The circuit of claim 1, wherein, by using the comparator and the controller, the two-stage amplifier is configured to modulate the number of the transistors that are to couple to the load by causing the controller to connect one or more of the transistors to and disconnect one or more of the transistors from the load.

5. The circuit of claim 1, wherein the two-stage amplifier is configured to provide a differential output to the comparator.

6. The circuit of claim 5, wherein, based on the differential output, the comparator is configured to provide a positive difference or a negative difference to the controller.

7. The circuit of claim 6, wherein:

based on receiving the positive difference, the controller is configured to connect one or more of the transistors to the load; and based on receiving the negative difference the controller is configured to disconnect one or more of the transistors from the load.

8. The circuit of claim 1, wherein the current density comprises an amount of current through each of the transistors coupled to the load.

9. The circuit of claim 8, wherein the two-stage amplifier is configured increase or decrease the amount of current through each of the transistors coupled to the load.

10. A method of forming a circuit, the method comprising:

providing a two-stage amplifier coupled to a transistor array and to a comparator, differential output terminals of the two-stage amplifier are coupled to input terminals of the comparator, the transistor array being configured to provide an output to a load, the transistor array comprising transistors; and coupling a controller to the comparator and the transistor array, the two-stage amplifier being configured to modulate a current density in the transistor array via gate terminals of the transistors, wherein, by using the comparator and the controller, the two-stage amplifier is configured to modulate a number of the transistors that are to couple to the load.

11. The method of claim 10, wherein the two-stage amplifier is configured to modulate the current density in the transistor array via the gate terminals of the transistors based on receiving the output from the transistor array and a reference voltage.

12. The method of claim 10, wherein the two-stage amplifier is configured to modulate the current density in the transistor array via the gate terminals of the transistors by modulating a gate voltage provided to the gate terminals.

13. The method of claim 10, wherein, by using the comparator and the controller, the two-stage amplifier is configured to modulate the number of the transistors that are to couple to the load by causing the controller to connect one or more of the transistors to and disconnect one or more of the transistors from the load.

14. The method of claim 10, wherein the two-stage amplifier is configured to provide a differential output to the comparator.

15. The method of claim 14, wherein, based on the differential output, the comparator is configured to provide a positive difference or a negative difference to the controller.

16. The method of claim 15, wherein:

based on receiving the positive difference, the controller is configured to connect one or more of the transistors to the load; and based on receiving the negative difference the controller is configured to disconnect one or more of the transistors from the load.

17. The method of claim 10, wherein the current density comprises an amount of current through each of the transistors coupled to the load.

18. The method of claim 17, wherein the two-stage amplifier is configured increase or decrease the amount of current through each of the transistors coupled to the load.

19. A circuit comprising:

a two-stage amplifier comprising an error amplifier, a replica amplifier, a replica transistor, a first transistor, and a second transistor, the two-stage amplifier being coupled to a transistor array and to a comparator, the transistor array being configured to provide an output to a load, the transistor array comprising transistors; and a controller coupled to the comparator and to the transistor array, the two-stage amplifier being configured to modulate a current density in the transistor array via gate terminals of the transistors, wherein, by using the comparator and the controller, the two-stage amplifier is configured to modulate a number of the transistors that are to couple to the load, the error amplifier being coupled to the second transistor and the comparator, the error amplifier being configured to provide a differential output to the comparator; and an input terminal of the replica amplifier is coupled to a drain terminal of the replica transistor and a source terminal of the first transistor, an output terminal of the replica amplifier being coupled to a gate of the first transistor.

* * * * *